US007210737B2

(12) United States Patent
Schaller

(10) Patent No.: US 7,210,737 B2
(45) Date of Patent: May 1, 2007

(54) FEEDING CHAIR APPARATUS

(76) Inventor: Maureen Harrison Schaller, 8256 Sunfish La., Maineville, OH (US) 45039

( * ) Notice: Subject to any disclaimer, the term of this patent is extended or adjusted under 35 U.S.C. 154(b) by 0 days.

(21) Appl. No.: 11/373,621

(22) Filed: Mar. 10, 2006

(65) Prior Publication Data

US 2006/0170260 A1 Aug. 3, 2006

Related U.S. Application Data

(63) Continuation of application No. 10/841,889, filed on May 7, 2004.

(51) Int. Cl.
*A47B 39/00* (2006.01)

(52) U.S. Cl. ..... 297/170; 297/174 R; 297/135; 297/423.2; 297/423.21; 297/148; 297/150

(58) Field of Classification Search ..... 297/148–151, 297/170, 174 R, 135, 188.01, 423.2, 423.21, 297/423.19
See application file for complete search history.

(56) References Cited

U.S. PATENT DOCUMENTS

| | | | | | |
|---|---|---|---|---|---|
| 133,867 | A | | 12/1872 | Manzari | |
| 183,924 | A | * | 10/1876 | Harrison | 182/33.3 |
| 355,230 | A | | 12/1886 | Taliaferro | |
| 406,313 | A | | 7/1889 | Smith | |
| 595,450 | A | * | 12/1897 | Archer | 297/423.19 |
| 967,452 | A | * | 8/1910 | Silverman | 297/188.11 |
| 975,188 | A | * | 11/1910 | Williams | 297/423.2 |
| 1,068,496 | A | | 7/1913 | Gordon | |
| 1,154,268 | A | | 9/1915 | Parker | |
| 1,402,698 | A | * | 1/1922 | Weingarten | 297/423.2 |
| 1,788,039 | A | | 1/1931 | Wujcik | |
| 2,177,174 | A | | 10/1939 | Eccles | |
| 2,470,834 | A | * | 5/1949 | Peltier | 297/149 |
| 2,658,225 | A | | 11/1953 | Bascom | |
| 2,667,207 | A | * | 1/1954 | Magyar | 297/134 |
| 2,694,439 | A | | 11/1954 | Murray | |
| 2,900,011 | A | | 8/1959 | Casey | |
| 2,919,748 | A | * | 1/1960 | Alden, Sr. | 297/153 |
| 3,213,467 | A | | 10/1965 | Hubbard | |
| 4,165,124 | A | | 8/1979 | Olan | |
| 4,193,630 | A | | 3/1980 | Steele | |
| 4,564,238 | A | | 1/1986 | Wolpert, Jr. | |
| 4,711,489 | A | | 12/1987 | Krause | |
| 5,277,477 | A | | 1/1994 | Sharff et al. | |
| 5,312,161 | A | | 5/1994 | Mars | |
| 5,348,374 | A | | 9/1994 | Kuo | |
| 5,489,140 | A | | 2/1996 | Van Horn-Plato | |

(Continued)

FOREIGN PATENT DOCUMENTS

FR 002565475 A1 12/1985

*Primary Examiner*—David R. Dunn
*Assistant Examiner*—Erika Garrett
(74) *Attorney, Agent, or Firm*—Hudak, Shunk & Farine Co. LPA

(57) ABSTRACT

A feeding chair or highchair apparatus having a first seat assembly for an infant or child and a second seat assembly for an adult or caregiver connected to and housed inside and preferably under the first seat assembly when not in use. In one embodiment, the adult seat assembly is detachable from the child chair assembly and positionable in relation thereto. In a further embodiment, the adult seat assembly is operatively connected to the child chair assembly and moveable to a plurality of positions in relation thereto.

12 Claims, 4 Drawing Sheets

U.S. PATENT DOCUMENTS

| | | | | |
|---|---|---|---|---|
| 5,685,600 | A | 11/1997 | Kuo | |
| 5,704,627 | A | 1/1998 | Davis et al. | |
| 5,806,922 | A | 9/1998 | Mendelovich | |
| 5,951,102 | A | 9/1999 | Poulson et al. | |
| 6,247,750 | B1 | 6/2001 | Tsai | |
| 6,273,503 | B1 | 8/2001 | Cheng | |
| 6,347,830 | B1 | 2/2002 | Chen | |
| 6,561,526 | B1 | 5/2003 | Towns | |
| 6,619,734 | B2 | 9/2003 | Helmsderfer | |
| 6,626,487 | B1 | 9/2003 | Buitendach | |
| 6,840,583 | B1 | 1/2005 | Turner et al. | |
| 7,052,082 | B1 * | 5/2006 | Thomas | 297/148 |
| 2002/0195847 | A1 | 12/2002 | Hsu | |

* cited by examiner

FEEDING CHAIR APPARATUS

CROSS-REFERENCE

This is a continuation of application Ser. No. 10/841,889, filed on May 7, 2004, of Maureen Harrison-Schaller, for FEEDING CHAIR APPARATUS.

FIELD OF THE INVENTION

The present invention relates to a feeding chair or highchair apparatus having a first seat assembly for an infant or child and a second seat assembly for an adult or caregiver connected to and housed inside and preferably under the first seat assembly when not in use. In one embodiment, the adult seat assembly is detachable from the child chair assembly and positionable in relation thereto. In a further embodiment, the adult seat assembly is operatively connected to the child chair assembly and moveable to a plurality of positions in relation thereto. The convertible apparatus can advantageously be employed to assist a caregiver with the feeding of an infant or child.

BACKGROUND OF THE INVENTION

Numerous different styles of feeding chairs or high chairs for infants or children are known in the art. High chairs are generally utilized to secure a child in a seated position for feeding. Typically, highchairs include a seat with a seat bottom, a seat back, and some form of side arms or other barriers to prevent a child from falling out of the seat. The seat is typically supported by four legs affixed to the seat. A tray is normally provided and is selectively attachable and detachable from the arms of the chair for cleaning or removal of the infant from the chair. In order to prevent a child from slipping or submarining out of the chair such as underneath the tray, the highchair is generally provided with a restraint system typically configured as a belt and buckle arrangement for fastening about the waist of the child and preventing movement out of the seat without disconnecting the belt system. As used herein the term "child" applies to any infant from birth up to the teenage years, although generally only children from a few months to a few years of age utilize highchairs.

U.S. Pat. No. 5,806,922 relates to a convertible highchair including a base, a board attachable to a lower portion and to an upper portion of the base, a chair attachable to the base by means of mechanical fasteners, the chair when attached to the base, and the board when attached to the lower portion of the base forming a highchair, wherein the chair includes a plurality of chair parts which are storable separately and which are assembled together by means of mechanical fasteners, and the base includes a plurality of base parts which are storable separately and which are assembled together by means of mechanical fasteners, and wherein the base and the chair are adapted to be assembled separately, the board being attached to the upper portion of the base, such that the base and the chair form a chair and table set, and wherein each mechanical fastener is storable attached to at least one of the chair and the base parts.

U.S. Pat. No. 6,347,830 relates to a highchair which includes a foldable frame having a pair of front legs and a pair of rear legs, a seat and a backrest mounted on the frame between the front legs and between the rear legs, and a pair of pivotal coupler devices, each of which is connected to one of the front legs and one of the rear legs.

U.S. Pat. No. 5,951,102 relates to a highchair which includes a removable tray with a single-handed actuation handle for actuating a release mechanism.

The prior art highchairs do not make any provision to aid a caregiver feeding the child. The highchair seat is often positioned at a height where it is awkward for an adult to stand and feed a child seated therein. Furthermore, most table chairs have seat bottoms which are at an incorrect height to allow a person seated therein to feed a child in a highchair, causing back strain or other problems.

SUMMARY OF THE INVENTION

The feeding chair apparatus of the present invention includes a feeding chair having a seat assembly for one or more, and preferably a single infant or child having a seat member connected to a base which is adapted to contact a ground surface and maintain the seat member a predetermined distance therefrom. The base generally comprises one or more legs attached to the seat member. Located in the base, preferably between the legs of the base, below the child seat member is a housing having connection element for connection to an adult seat assembly removably connectable or nested in the housing. When desired, the adult seat assembly can be disconnected or moved out from the housing and utilized as a stool, chair or seat, etc.

In one embodiment, the feeding chair housing includes a rail member attached to each leg assembly. The adult seat assembly is removably and slidably connected to the rail members. In a preferred embodiment, the adult seat assembly has a seat bottom which has a lower surface that is removably connected to the upper surface of the housing rail members. In yet a further embodiment, the adult seat assembly has leg members which fold into the adult seat assembly bottom. The adult seat assembly when connected to the folding chair housing, can be also utilized as a shelf or storage tray with miscellaneous items being storable thereon when the adult seat assembly is not in use.

In a further embodiment, the child feeding chair assembly base includes a bottom member that extends a predetermined distance between the leg assemblies. The adult seat assembly is located within the housing and generally conforms to the shape thereof. The adult seat assembly has a leg(s) which contacts the bottom member of the housing and generally rest thereon. When desirable, the adult seat assembly is detached from the housing and utilized to aid in feeding a child in the feeding chair.

In yet a further embodiment, the feeding chair apparatus includes an adult seat assembly operatively connected to a child chair assembly and positionable in relation thereto at at least a plurality of positions and/or distances therefrom. The adult seat assembly and child chair assembly are connected by a connecting member such as a rail, an arm or the like which is preferably pivotally or slidably connected between each assembly. In various embodiments, the arm is a swing arm, or a telescoping arm, or a combination thereof. In preferred embodiments, the arm is attached at one end to a leg of the child chair assembly and at a second end to a leg of the adult seat assembly.

BRIEF DESCRIPTION OF THE DRAWINGS

The invention will be better understood and other features and advantages will become apparent by reading the detailed description of the invention, taken together with the drawings wherein.

DETAILED DESCRIPTION OF INVENTION

Figure 2:
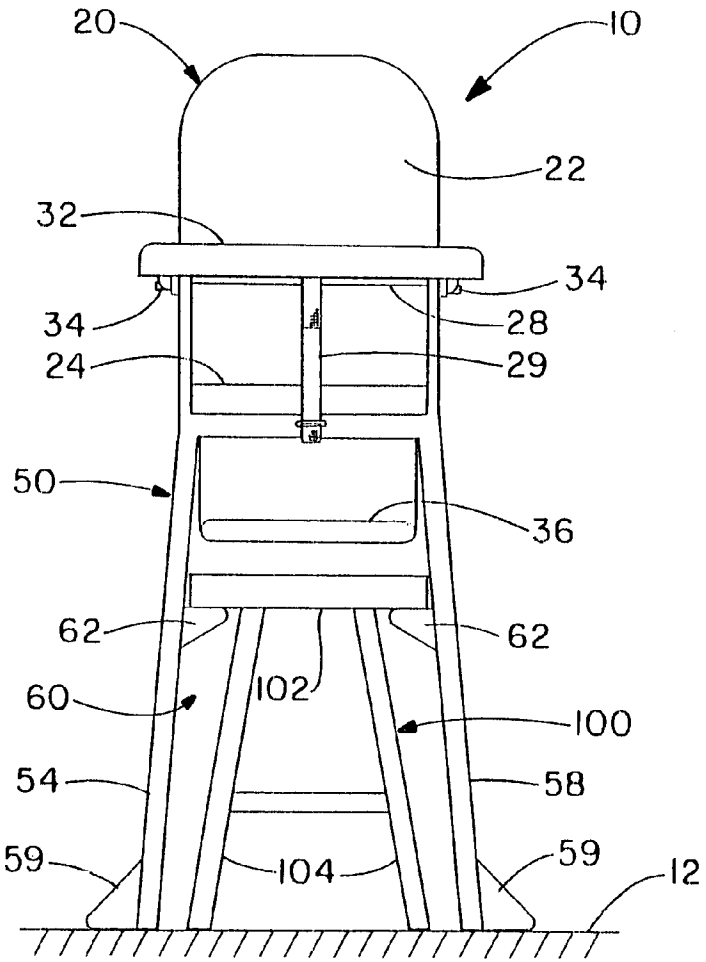
FIG. 2 is a front view of the apparatus illustrated in FIG. 1.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

The feeding chair apparatus of the present invention is described in detail hereinbelow wherein the preferred embodiments have been set forth. Making reference now to the drawings, one embodiment of the feeding chair apparatus of the present invention is shown generally in FIG. 1 and is designated by reference numeral 10. The apparatus 10 includes a child chair or highchair assembly 20 having a seat member 21 for an infant or child in combination with an adult seat assembly 100 for a caregiver which is removable and displaceable from the child seat assembly, to assist in feeding the child. The adult seat assembly 100 is operatively connected to and located in the housing 60 provided in the child chair assembly 20 below child seat member 21.

The feeding chair apparatus 10 child chair assembly 20 includes base or frame 50 adapted to reside on a ground surface 12. Assembly 20 also includes child seat member 21 having a seat back 22 and seat bottom 24 which are either integrally connected such as by molding or otherwise connected with a suitable bracket and/or fastening mechanism such as nuts and bolts, etc. The seat back 22 can be disposed at an angle with respect to horizontal which varies generally from about 65° to about 90°, desirably from about 70° to about 90°, and preferably from about 80° to about 90° in order to maintain a child seated in the seat member in a convenient position for feeding. Likewise, the seat bottom can be inclined or declined with respect to horizontal at a predetermined angle. In one embodiment, the child seat member 21 includes a securing belt 30 which is adjustably attached to either the seat back 22 or seat bottom 24, or a combination thereof in order to further restrain the child within the apparatus 10.

Child seat member 21 further includes a side member 26 connected to seat back 22 or seat bottom 24, or both to aid in preventing the child from falling out of the child seat member 21. Each side member 26 can be fashioned as an arm or a sidewall having a predetermined height to partially surround the child while in the chair. Each side member 26 can be substantially straight or curved. In one embodiment, the child seat member 21 is further provided with a front restraining bar or support 28 which extends between and connects side members 26 as illustrated in FIG. 2. Front support 28 is located a predetermined distance from seat back 22 to allow placement of child within the seat. In some embodiments, front support 28 and center support 29 are removable to allow removal of a child seated in seat member 21 or for ease of cleaning, etc. Center support 29 is in some embodiments removably connected to seat bottom 24 and front support 28, and is further adapted to be located between a child's legs seated in the chair in order to prevent submarining of the child out of the front of the child seat member 21 below the front support 28.

Figure 1:
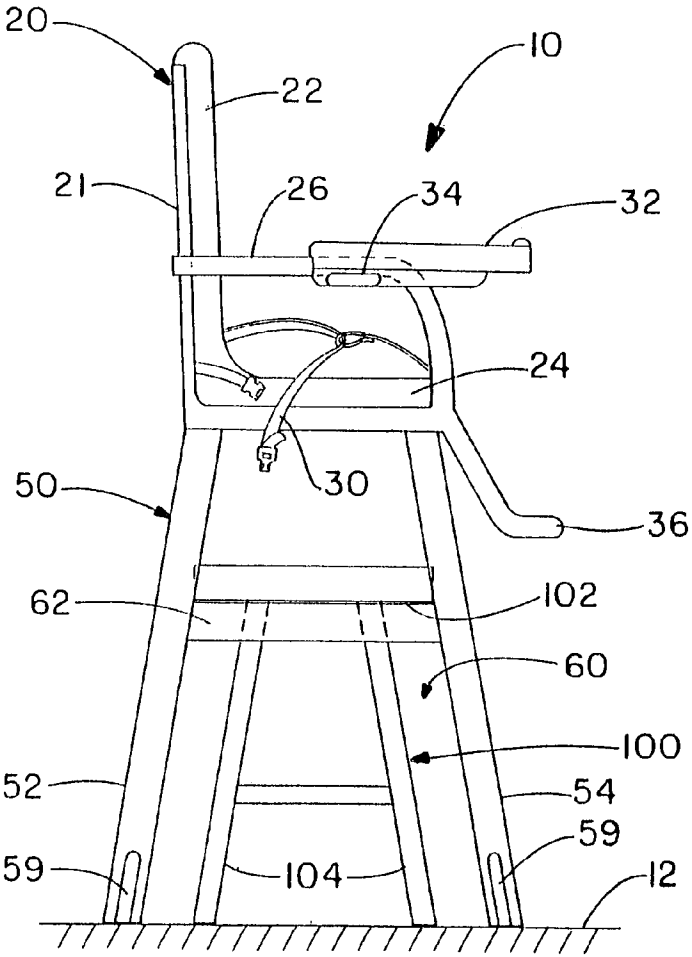
FIG. 1 is a side view of one embodiment of a feeding chair apparatus of the present invention.

In a preferred embodiment, a tray 32 is removably connected to child seat member 21 utilizing release mechanism 34 connected to the bottom or sides of tray 32 as illustrated in FIGS. 1 and 2. The tray 32 is generally connectable at a plurality of positions in relation to seat back 22 as known in the art and can be moved toward or away from a child seated within the child seat member if desired for better positioning. The tray 32 can be lifted off of the seat member when the release mechanism 34 is disengaged allowing cleaning of the tray 32 or greater access to the remaining seat portion of the seat member. The tray 32 serves as a support for any of various objects and accordingly can have any desirable surface area or configuration in order to hold bottles, cups, plates, toys or the like. In a preferred embodiment, the seat and back members 22, 24 are integrally molded, optionally with side members 26. An enclosure assembly including the front bar 28 and center strut 29 are integrally molded in a preferred embodiment and can be operatively connected to the seat and/or back member 22, 24. As known in the art, the child seat member can be fitted with a cover, cushion, or a combination thereof which is preferably easily cleanable in order to provide an aesthetically pleasing design and/or comfort to the child seated therein. In some embodiments, footrest 36 is operatively connected to child chair assembly 21 such as to seat bottom 24. The footrest 36 is generally aligned with the seat and adapted to receive and support the feet of a child sitting in the child chair assembly 20. The bottom or lower most portion of footrest 36 is preferably situated at a height above the uppermost portion of adult seat assembly 100. In an alternative embodiment, footrest 36 includes a hinge where the same is connected to another portion of the chair assembly 20 such as to seat bottom 24 so that footrest 36 can be lifted in order to gain access to housing 60 and adult seat assembly located therein.

Figure 4:
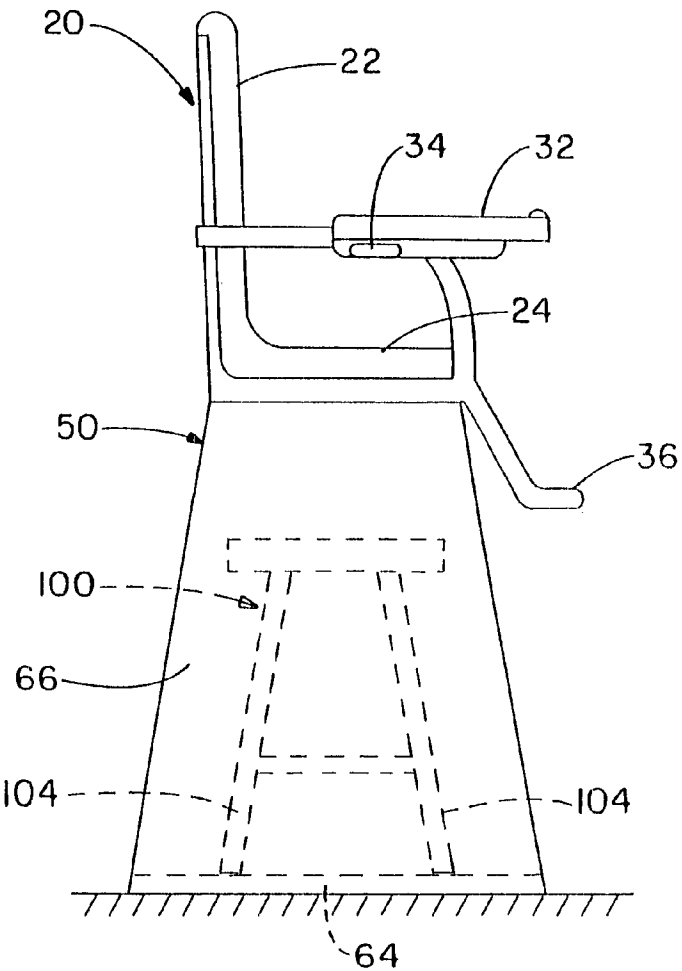
FIG. 4 is a side view of the apparatus in FIG. 3.
Figure 3:
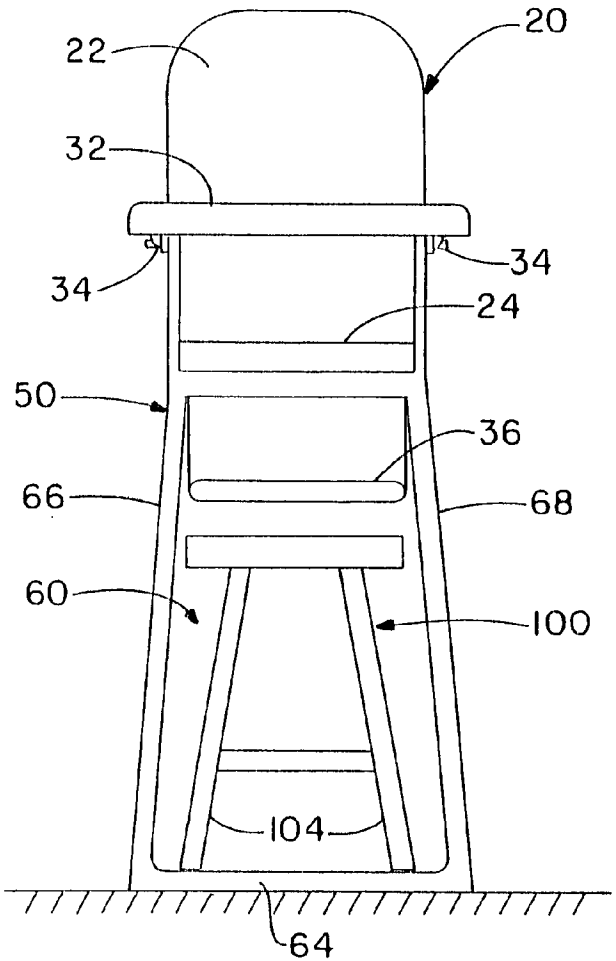
FIG. 3 is a front view of a further embodiment of a feeding chair apparatus of the present invention.

The child seat member 21 is mounted on base or frame 50 as illustrated in FIGS. 1–4. Base 50 includes two or more legs 52, 54, 56 (FIG. 6) and 58 as illustrated in FIGS. 1 and 2. The area between the legs of base 50 and/or below child seat member 21 forms housing 60 for detachable adult seat assembly 100. The upper ends of each leg are directly connected to the child seat assembly or indirectly or operatively connected through a bracket, securing bar, or other element as known in the art. The legs can be equipped with feet 59 if desired to increase stability of the chair 10. As further illustrated in FIGS. 3 and 4, legs 66 and 68 include bottom or lower member 64 which extends inwardly a predetermined distance from the lower end of each leg and preferably completely therebetween as shown in FIG. 3. As illustrated in FIGS. 3 and 4, only one leg 66 and 68 is present on each side of the apparatus 10 which extend a predetermined width such as about 12 to about 36 inches and preferably from about 18 to about 24 inches in order to provide stability to the feeding chair apparatus 10. As illustrated in FIGS. 3 and 4, access to housing 60 is attained from the front or rear of chair 10. In other embodiments, base 50 is oriented so that housing 60 can be accessed from either side of the chair with legs 66 and 68 extending across the front and rear portions of the chair respectively.

Detachable adult seat assembly 100 illustrated in FIGS. 1 and 2 is operatively connected to child chair assembly 20 through adult seat assembly holding element 62. A holding element 62 is connected between each pair of front and back legs 52, 54 and 56, 58. In the embodiment of FIGS. 1 and 2, holding element 62 is fashioned as a rail extending a predetermined distance between a pair of legs whereupon adult seat assembly 100 can be positioned and operatively connected to child seat member 20. As illustrated, detachable adult seat assembly 100 is substantially in the shape of a seat or chair, particularly a stool which substantially conforms to the dimensions of housing 60 and is housed therein. Adult seat assembly can have generally any shape or structure as known to those of ordinary skill in the art. The adult seat assembly 100 is removed from within child chair assembly 20 by sliding the bottom or underside portion of seat bottom 102 along the upper surface of holding element 62 and out of base 50. Detachable adult seat assembly 100 includes one or more legs 104 which are utilized to stabilize the adult seat assembly when utilized independently of child seat member 20.

In a further embodiment illustrated in FIGS. 3 and 4, adult seat assembly 100 is operatively connected to and housed within housing 60 of child seat member 20 through a bottom portion of at least one leg 104 which rests upon base 50 bottom member 64. Detachable adult seat assembly 100 substantially fits within housing 60 and can be pushed, pulled or otherwise moved out from under child seat member 20 and utilized independently to seat an adult to aid in feeding a child seated within child seat member 20.

Figure 5:
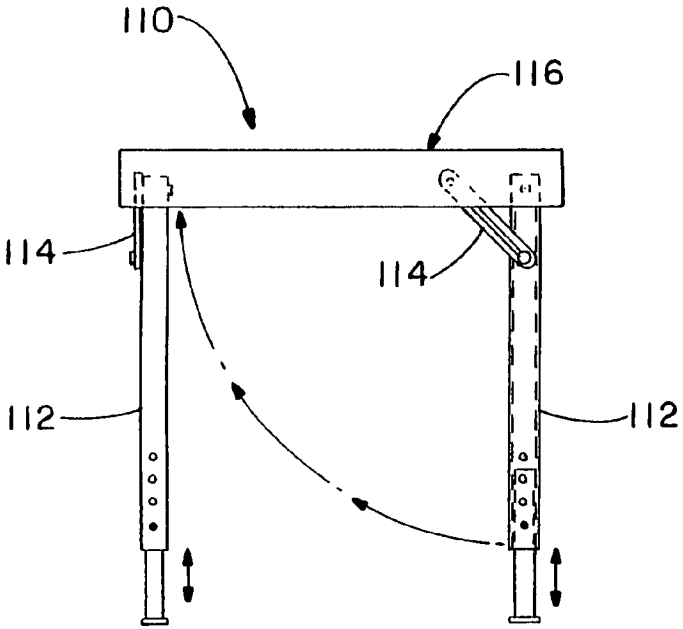
FIG. 5 is a front elevational view of one embodiment of an adult seat assembly having legs which fold into the seat bottom and are capable of telescoping to provide a desired seat height.

In a further embodiment as illustrated in FIG. 5, detachable adult seat assembly 110 includes one or more foldable legs 112. In a preferred embodiment, four foldable legs 112 are utilized and are able to move from an extended fixed position substantially perpendicular to the plane formed by seat housing 116 to a folded position located inside seat housing 116. A locking mechanism 114 is utilized to maintain leg 112 in an extended position. Suitable locking mechanisms are known in the art and are commonly utilized for folding chairs, tables and the like. Adult seat assembly 110 with legs in a folded position 112 can be inserted into housing 60 as illustrated in FIG. 1 with the bottom portion of seat housing 116 resting on the upper surface of adult seat assembly holding element 62. The flat upper surface of the seat housing can be utilized as a tray or storage area for any of various items such as baby food, bibs, diapers, etc. when operatively connected to child seat member 20 of feeding chair apparatus 10. In a further embodiment, the adult seat assembly 110 is provided with one or more telescoping legs as illustrated in FIG. 5 in order to adjust the seat assembly to a desired height which provides a comfortable seated position for a person seated thereon. Telescoping mating tubes, threaded tubes, or the like can be utilized in order to provide height adjustment. The adult seat assembly of the present invention can have a seating surface height which ranges generally from about 12 to about 36 inches, desirably from about 16 to about 30 inches, and preferably for about 18 to about 24 inches, and can be based on the height proportional to the child highchair seat member.

Figure 6:
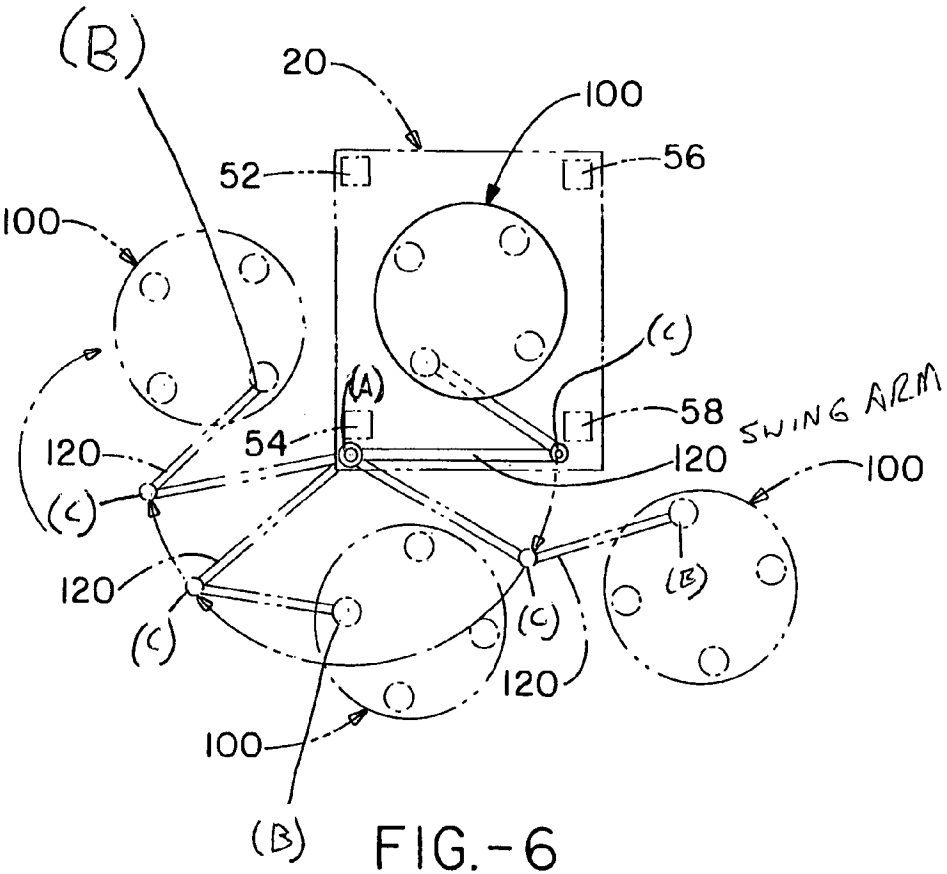
FIG. 6 is a cross-sectional top view of a further embodiment of a feeding chair apparatus having an arm or other member connecting the adult seat assembly to the child chair assembly.

A further embodiment of the feeding chair apparatus 10 of the present invention is illustrated in FIG. 6. Therein, the adult seat assembly 100 is operatively connected to the child chair assembly 20 through connecting member 120. One portion or end of connecting member 120 is connected, preferably pivotally to a portion of the child chair assembly 20, such as leg 54. Alternatively, the connecting member can be connected to any other structure of child chair assembly 20. The second portion or end of connecting member 120 is connected to adult seat assembly 100 such as a leg thereof as shown in FIG. 6. As illustrated in FIG. 6, connecting member 120 is a swing arm which allows adult seat assembly to be positioned within housing 60 of the child chair assembly 20 when not in use. When desired, the adult seat assembly 100 can be removed from housing 60 by moving connecting member 120 to any desired position out from within housing 60. The adult seat assembly can be located at a plurality of positions in relation to child chair assembly 20, four of which are illustrated in FIG. 6. The connecting member can be a swing arm, telescoping mechanism, sliding members, mateable members or the like in order to operatively connect adult seat assembly 100 to child chair assembly 20. A further embodiment of the connecting member is described hereinbelow.

Figure 7:
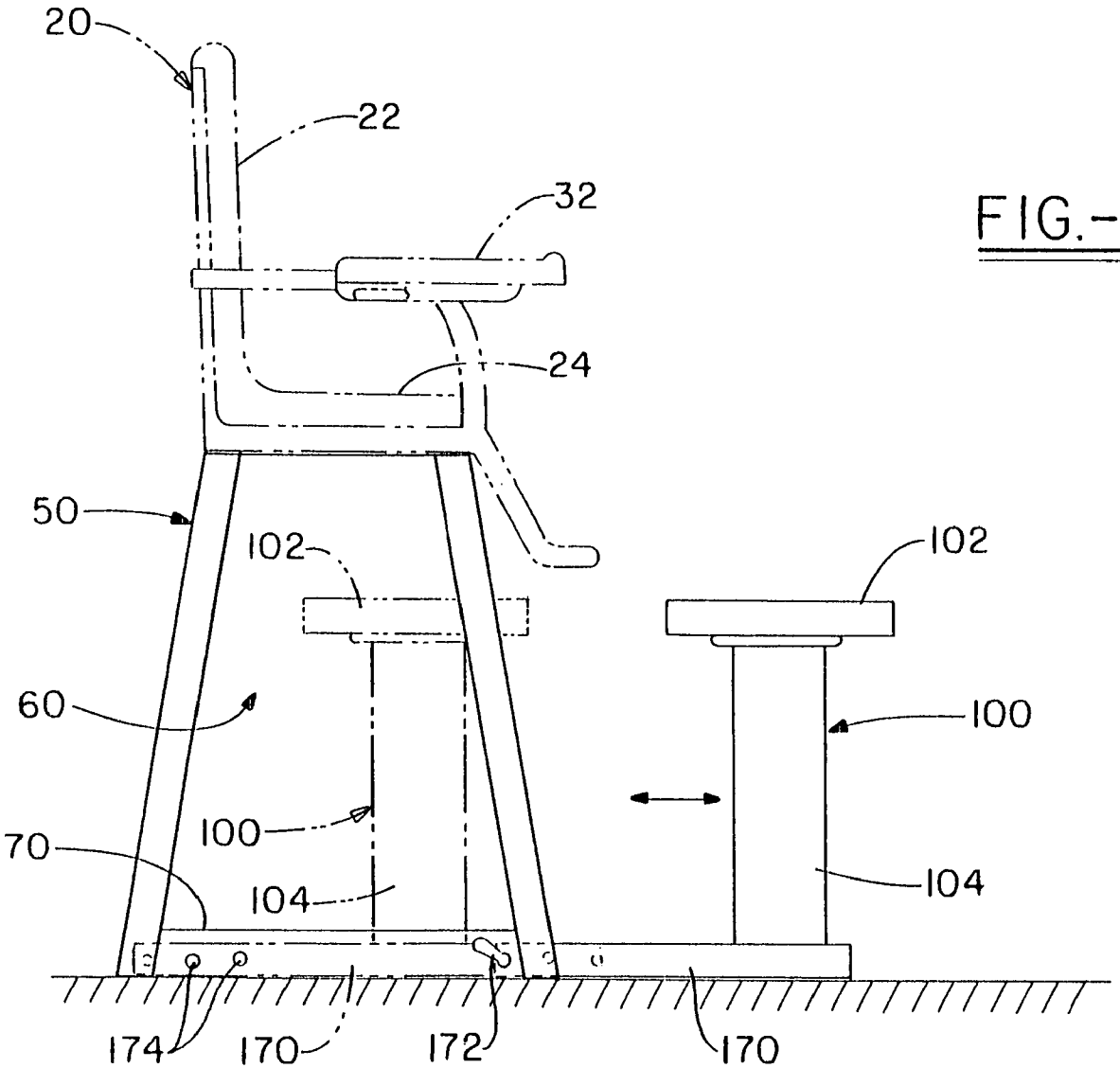
FIG. 7 is a side view of a further embodiment of the feeding chair apparatus of the present invention illustrating an adult seat assembly moveable from a position inside and conforming to the shape of the child seat assembly housing to at least a second position outside of the housing in order to seat a person therein.

FIG. 7 illustrates further embodiment of the present invention feeding chair apparatus 10. In this embodiment, the adult seat assembly 100 and child chair assembly 20 are operatively connected by a connecting member 170. As illustrated in FIG. 7 the adult seat assembly includes connecting member 170 which is connected between both seat assemblies 20 and 100. The connecting member 170 can be, but is not limited to mateable rails, guides, glides, tubes or other similar structure. The connecting member can optionally include rollers or other friction reducing elements. Any mateable means or connecting mechanisms known in the art can be utilized. The connecting member is adjustable in length to a multitude of positions. Thus, adult seat assembly 100 having seat 102 which can be a swivel seat or height adjustable, or the like, or a combination thereof, can be moved from an inactive position in housing 60 of child chair assembly 20 and pulled out to one or more active positions a predetermined distance from child chair assembly 20 wherein seat 102 is adapted to be sat upon by a person. Mateable member 170 can even be utilized as a footrest if desired. A locking mechanism 172 and locking position apertures can be provided to maintain a desired distance between the seat assemblies 20 and 100. Adult seat assembly 100, seat 102 and 104 can have any shape or form and generally conforms to the interior dimensions of housing 60 of base 50.

The feeding chair apparatus 10 can be constructed of generally any materials or combinations thereof such as plastic, metal, wood, or the like. In a preferred embodiment, the structural members such as the child chair assembly and adult seat assembly are constructed from plastic such as polyethylene or polypropylene having structural rigidity as well as the necessary resilience to impact. It is often preferable to utilize metal fasteners to connect or reinforce plastic structural parts where strength is needed.

In accordance with the patent statutes, the best mode and preferred embodiment have been set forth, the scope of the invention is not limited thereto, but rather by the scope of the attached claims.

What is claimed is:

1. A feeding chair apparatus, comprising: a highchair adapted for use by a child having a first seat member and a base connected to the first seat member; and a second seat member operatively connected to the highchair by a connecting member, wherein the first seat member has a seat back, a seat bottom, two side members and a belt or front support or both adapted to extend between legs of the child when seated in the first seat member to prevent the child from falling out of the seat member, wherein the side members are connected to the seat back, the seat bottom, or both, wherein the second seat member has a seating surface height which ranges from about 12 to about 36 inches from a ground surface, and wherein the second seat member is adapted to be moved and positioned a distance out from under the first seat member for at least seating a person feeding a child seated in the first seat member, wherein the connecting member has a first end portion operatively connected to the first seat member or first seat member base and a second end portion operatively connected to the second seat member, wherein the connecting member comprises a swing arm having the first end portion pivotally connected to the first seat member or first seat member base, a second end portion pivotally connected to the second seat member and a pivot point located between the first end portion and the second end portion that allows the second seat member to be positioned at a plurality of active positions out from under the first seat member a distance with one or more legs of the second seat member adapted to be in contact with the ground surface.

2. The apparatus according to claim 1, wherein the base includes one or more legs, wherein the connecting member first end portion is connected to the base, and wherein the second seat member is substantially positionable in the base for storage.

3. The apparatus according to claim 2, wherein the second seat member includes one or more folding legs, one or more height adjustable legs, or a combination thereof.

4. The apparatus according to claim 2, wherein the child seat member further includes a tray removably connected to the side members.

5. The apparatus according to claim 1, wherein the connecting member first end portion is connected to a lower portion of the base and the second end portion is connected to a lower portion of the second seat member.

6. The apparatus according to claim 5, wherein the second seat member includes one or more folding legs, one or more height adjustable legs, or a combination thereof.

7. The apparatus according to claim 5, wherein the child seat member further includes a tray removably connected to the side members.

8. The apparatus according to claim 1, wherein the second seat member includes one or more folding legs, one or more height adjustable legs, or a combination thereof.

9. The apparatus according to claim 1, wherein the child seat member further includes a tray removably connected to the side members.

10. A feeding chair apparatus, comprising: a child chair assembly having a child seat member; and an adult seat assembly located in a housing of said child chair assembly and operatively connected thereto by a connecting member, wherein the child chair assembly has a seat back, a seat bottom, two side members and a belt or front support or both adapted to extend between legs of a child when seated in the first seat member to prevent the child from falling out of the chair assembly, wherein the side members are connected to the seat back, the seat bottom, or both, wherein the adult seat assembly has a seating surface height which ranges from about 12 to about 36 inches from a ground surface, and wherein the adult seat assembly is adapted to be moved and positioned a distance out from under the child chair assembly at a plurality of active positions with one or more legs of the adult seat assembly adapted to be in contact with the ground surface for at least seating a person feeding a child seated in the child chair assembly, wherein the connecting member has a first end portion operatively connected to the child chair assembly and a second end portion operatively connected to the adult seat assembly, and wherein the connecting member comprises a swing arm having the first end portion pivotally connected to the child chair assembly, a second end portion pivotally connected to the adult seat assembly and a pivot point located between the first end portion and the second end portion.

11. The apparatus according to claim 10, wherein the child seat member includes a tray removably connected to the side members, and wherein the child chair assembly seat bottom has two or more legs defining the housing therebetween.

12. The apparatus according to claim 10, wherein the connecting member first end portion is connected to a lower portion of the child chair assembly and the second end portion is connected to a lower portion of the adult seat assembly.

* * * * *